US008867952B2

(12) United States Patent
Kim et al.

(10) Patent No.: US 8,867,952 B2
(45) Date of Patent: Oct. 21, 2014

(54) IMAGE CARRIER AND IMAGE FORMING APPARATUS HAVING THE SAME

(71) Applicant: Samsung Electronics Co., Ltd., Suwon-si (KR)

(72) Inventors: Sung Jin Kim, Suwon-si (KR); Young Wok Seo, Suwon-si (KR); Jong Woo Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 44 days.

(21) Appl. No.: 13/684,889

(22) Filed: Nov. 26, 2012

(65) Prior Publication Data

US 2013/0136483 A1 May 30, 2013

(30) Foreign Application Priority Data

Nov. 28, 2011 (KR) ..... 10-2011-0125223

(51) Int. Cl.
*G03G 15/00* (2006.01)
*G03G 21/20* (2006.01)
*G03G 21/10* (2006.01)

(52) U.S. Cl.
CPC ..... *G03G 21/10* (2013.01); *G03G 15/751* (2013.01); *G03G 21/206* (2013.01)
USPC ..... 399/92; 399/96; 399/159

(58) Field of Classification Search
USPC ..... 399/92, 96, 159
See application file for complete search history.

(56) References Cited

U.S. PATENT DOCUMENTS

| | | | | |
|---|---|---|---|---|
| 7,024,130 | B2 * | 4/2006 | Serizawa et al. | 399/96 |
| 2002/0110387 | A1 * | 8/2002 | Fujishiro | 399/159 |
| 2011/0123215 | A1 * | 5/2011 | Nishimura et al. | 399/92 |

FOREIGN PATENT DOCUMENTS

| | | | |
|---|---|---|---|
| JP | 04-199081 | A * | 7/1992 |
| JP | 2005-181805 | A * | 7/2005 |
| JP | 2006-285107 | A * | 10/2006 |

* cited by examiner

*Primary Examiner* — Sophia S Chen
(74) *Attorney, Agent, or Firm* — Staas & Halsey LLP

(57) ABSTRACT

An image forming apparatus includes an image carrier on which an electrostatic latent image is formed, where the image carrier may include an image carrier body having a hollowness and image carrier flanges, which are installed at both ends of the image carrier body. Each image carrier flange may include a blower fan integrally formed therewith, so that air outside of the image carrier body is moved from one end of the image carrier body, at which a drive gear is positioned, to the other end of the image carrier body as the image carrier rotates. Waste developer which may accumulate on the drive gear is reduced, thereby preventing the operational error of the image carrier and thus avoiding the degradation of the image quality.

23 Claims, 4 Drawing Sheets

IMAGE CARRIER AND IMAGE FORMING APPARATUS HAVING THE SAME

CROSS-REFERENCE TO RELATED APPLICATIONS

This application claims the priority benefit of Korean Patent Application No. 10-2011-0125223, filed on Nov. 28, 2011 in the Korean Intellectual Property Office, the disclosure of which is incorporated herein by reference.

BACKGROUND

1. Field

Embodiments disclosed herein relate to an image carrier to carry an electrostatic latent image and a visible image, and an image forming apparatus having the same.

2. Description of the Related Art

An image forming apparatus is an apparatus designed to form an image on a printing medium according to a signal, and includes a printer, a copy machine, a facsimile, and a multifunctional device which incorporates the functionalities of the printer, the copy machine, and the facsimile (which may be referred to as a multifunctional peripheral device or MFP).

An electrophotographic image forming apparatus, as a type of the image forming apparatus, is provided with an image carrier, a light scanning unit and a developing unit. The light scanning unit scans a beam of light to the image carrier charged with a predetermined electric potential to form an electrostatic latent image on the surface of the image carrier, and the developing unit supplies developer to the image carrier, on which the electrostatic latent image is formed, forming a visible image.

In general, the colors of toner used for the image forming apparatus include yellow (Y), magenta (M), cyan (C) and black (K). In order to attach the four colors of toner to the electrostatic latent image, four developing units are needed.

There are two variants of image forming schemes. The first is a single-pass scheme in which an image carrier is provided in each of the four developing units. The second is a multi-pass scheme in which an image carrier is shared among the four developing units.

SUMMARY

Therefore, it is an aspect of the present disclosure to provide an image forming apparatus capable of preventing an image carrier from having an operational error due to waste developer.

Additional aspects of the disclosure will be set forth in part in the description which follows and, in part, will be apparent from the description, or may be learned by practice of the disclosure.

In accordance with one aspect of the present disclosure, an image forming apparatus includes an image carrier, a first image carrier frame, and a second image carrier. The image carrier may have an electrostatic latent image formed thereon. The first image carrier frame may have one side of the image carrier rotatably installed thereto. The second image carrier frame may have an other side of the image carrier rotatably installed thereto. The image carrier may include an image carrier body, a first image carrier flange and a second image carrier flange. The image carrier body may be provided in the form of a cylinder having a hollowness. The first image carrier flange may be installed at one end of the image carrier body. The second image carrier flange may be installed at another end of the image carrier body. At least one of the first image carrier flange and the second image carrier flange may include a blower fan allowing air to pass through inside the image carrier body in one direction. The first image carrier frame may include a guide rib configured to guide air, which is discharged through the one end of the image carrier body, toward a radially outward direction of the image carrier body. The second image carrier frame may include a through-hole that allows air to pass therethrough, and be introduced to the inside of the image carrier body.

The blower fan may allow the air to be drawn to the inside the image carrying body through the other end of the image carrier body, and then to be discharged through the one end of the image carrier body.

The image forming apparatus may further include a drive gear configured to transmit a rotating force to the image carrier. The first image carrier flange may be provided at an outer circumferential surface thereof with a gear portion that is engaged with the drive gear.

The first image carrier flange may include a flange portion which is provided in the form of a ring. The image forming apparatus may further include a gear member which is provided in the form of a ring corresponding to the flange portion and provided at an outer circumferential surface thereof with the gear portion. The gear member may be coupled to the first image carrier flange.

The guide rib may extend toward the drive gear to guide the air, which is being discharged through the other end of the image carrier body, toward the drive gear.

According to another aspect of the disclosure, an image carrier may be disposed in an image forming apparatus, the image carrier including a hollow image carrier body, a first blower fan disposed at a first end of the image carrier body and a second blower fan disposed at the second end of the image carrier body. The first blower fan may draw air into the image carrier body through the second end of the image carrier body, and discharge air out of the image carrier body through the first end of the image carrier body, and the second blower fan may guide air inside of the image carrier body. The image carrier may further include a shaft disposed inside the image carrier body along a central longitudinal axis of the image carrier body, wherein the second blower fan guides air in a direction parallel to the central longitudinal axis of the image carrier body.

The image carrier may further include a first image carrier frame including a first shaft installation hole to support a first end of the shaft and a plurality of guide ribs to guide air discharged from the first blower fan out of the image carrier body in a radially outward direction, and a second image carrier frame including a second shaft installation hole to support a second end of the shaft and a plurality of through holes arranged circumferentially about the second shaft installation through which air is drawn into the image carrier body.

The image carrier may also include a flange installed at the first end of the image carrier body and a gear member coupled to the flange. A drive gear of the image forming apparatus may engage the gear member to transmit a rotating force to the image carrier body, first blower fan, and second blower fan such that air discharged from the first blower fan prevents waste developer from accumulating on the drive gear.

The first blower fan and second blower fan may include a plurality of blades and, the plurality of blades of the first blower fan may be shaped differently from the plurality of blades of the second blower fan. The first blower fan may be a centrifugal type blower fan, and the second blower fan may be an axial type blower fan.

As described above, the air outside of an image carrier body is moved from one end of an image carrier, at which a drive gear is connected, to the other end of the image carrier, so that the waste developer generated from the image carrier is moved from the one end of the image carrier to the other end of the image carrier together with the air. Accordingly, the drive gear provided at the one end of the image carrier is prevented from being contaminated due to the waste developer, so that operational errors of the image carrier may be reduced.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
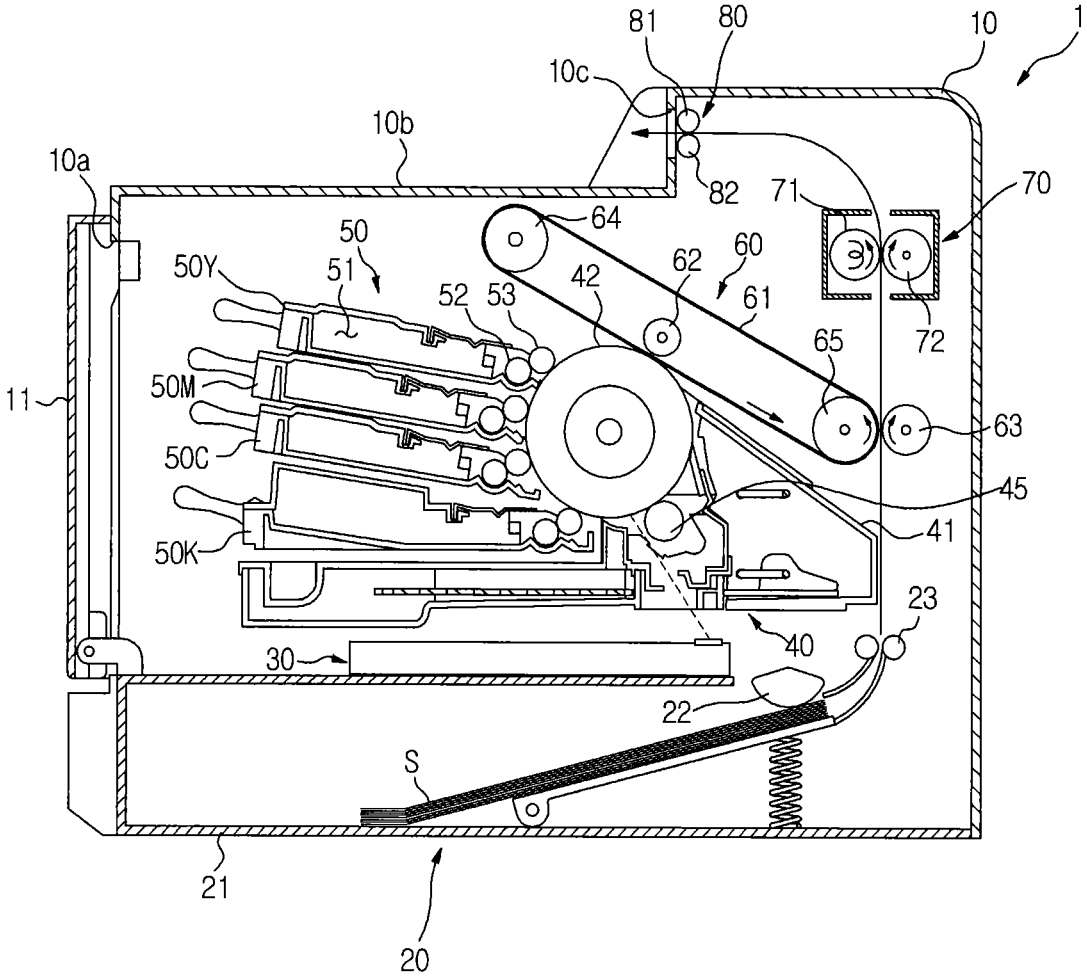
FIG. 1 is a view schematically illustrating an image forming apparatus in accordance with one embodiment of the present disclosure.

Reference will now be made in detail to the embodiments of the present disclosure, examples of which are illustrated in the accompanying drawings, wherein like reference numerals refer to like elements throughout.

Referring to FIG. 1, an image forming apparatus 1 includes a body 10, a printing medium feeding unit 20, a light scanning unit 30, an image carrier unit 40, a developing unit 50, a transfer unit 60, a fixing unit 70, and a printing medium discharge unit 80.

The body 10 forms the external appearance of the image forming apparatus 1, and supports various components that are installed inside the body 10. The body 10 may be provided at one side thereof with an opening 10*a*, through which the components inside of the body 10 are detachable. That is, the opening 10*a* may allow a user to access various components disposed within the image forming apparatus 1 to remove and/or replace the components as needed, perform maintenance, or clear paper jams for example. A side cover 11 having a lower end thereof rotatably installed to the opening 10*a* of the body 10 is provided so as to open/close the opening 10*a* with rotation of the side cover 11. The body 10 may be provided at an upper surface thereof with a loading portion 10*b* on which a printing medium having completed with the image formation is loaded. For example, when a printing medium is discharged from the printing medium discharge unit 80, consecutively discharged printing mediums may be stacked in a predetermined order on the loading portion 10*b*. A discharge portion 10*c* is provided at one side of the loading portion 10*b* to discharge the printing medium having completed with the image formation onto the loading portion 10*b*.

The printing medium feeding unit 20 includes a cassette 21 to store a printing medium S, a pickup roller 22 to pick up the printing medium one by one, and a transportation roller 23 to transport the printing medium S, which is picked up, to the transfer unit 60. The printing medium S used by the image forming apparatus 1 may include printing paper sheets such as glossy paper, plain paper, art paper, overhead projector film, and the like.

The light scanning unit 30 may be disposed at a lower side of the image carrier unit 40. That is, the light scanning unit 30 may be positioned below the image carrier unit 40. The light scanning unit 30 forms an electrostatic latent image on the surface of an image carrier 42 by scanning light, which corresponds to image information, to the image carrier 42. For example, light may be transmitted from the light scanning unit 30 to the image carrier 42 in an upward diagonal direction, substantially along a path as shown by the dashed lines in FIG. 1.

Figure 2:
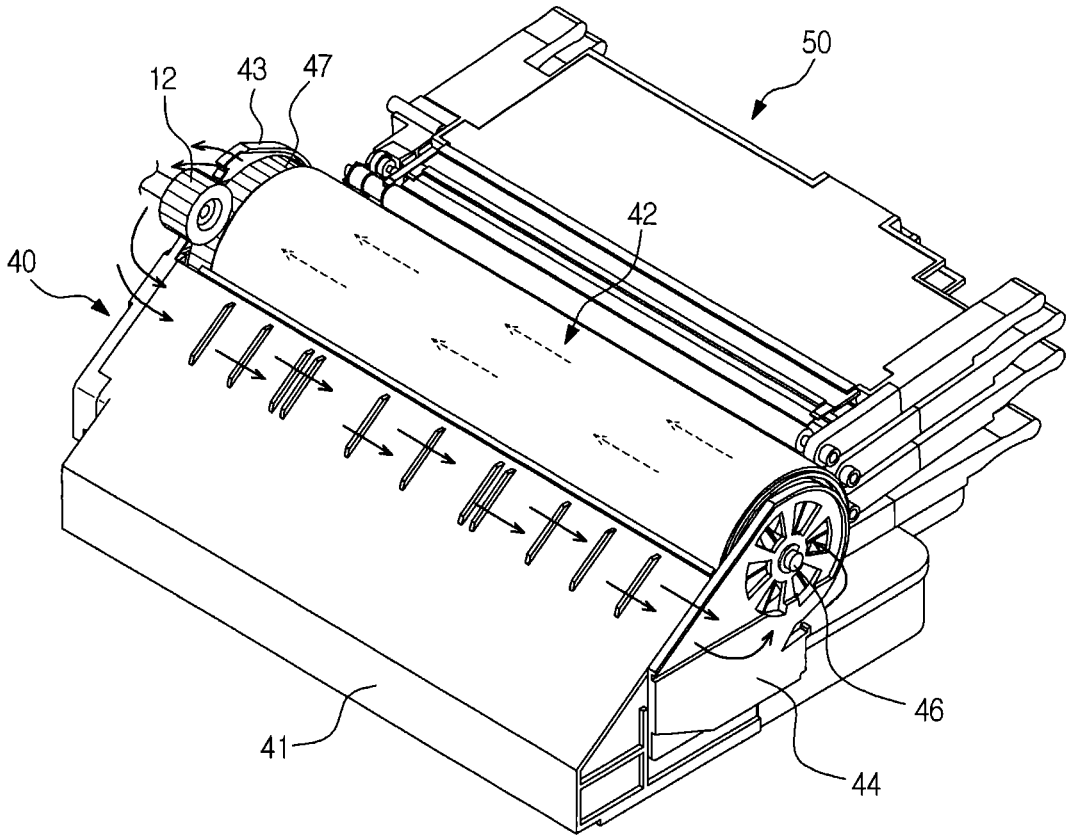
FIG. 2 is a perspective view illustrating an image carrier unit and a developing unit applied to the image forming apparatus in accordance with the embodiment of the present disclosure.

Referring to FIG. 1 and FIG. 2, the image carrier unit 40 may include an image carrier housing 41, the image carrier 42, a first image carrier frame 43, a second image carrier frame 44, a charging roller 45, and a shaft 46. The image carrier 42 carries an electrostatic latent image formed by the light scanning unit 30 and a visible image formed by the developing unit 50. The first image carrier frame 43 and the second image carrier frame 44 are installed at both sides of the image carrier housing 41, respectively, to rotatably support both ends of the image carrier 42. The charging roller 45 charges the image carrier 42 with a predetermined electric potential before a beam of light is scanned by the light scanning unit 30. The shaft 46 enables the image carrier 42 to be rotatably installed at the first image carrier frame 43. A drive gear 12 to drive the image carrier 42 may be provided at an inner side of the body 10. The drive gear 12 may rotate the image carrier 42 by engaging a gear member 47 disposed on an end portion of the image carrier 42, adjacent to the drive gear 12.

The developing unit 50 forms a visible image by supplying developer to the image carrier 42 on which an electrostatic latent image is formed. The developing unit 50 is composed of four developing devices 50Y, 50M, 50C, and 50K to receive different colors of developers, for example, Yellow (Y), Magenta (M), Cyan (C), and Black (K), respectively.

Each of the developing devices 50Y, 50M, 50C, and 50K may include a developer receiving portion 51 to receive developer that is to be supplied to the image carrier 42, a developing roller 53 disposed opposite the image carrier 42 to supply the image barrier 42 with developer, and a feeding roller 52 to supply the developing roller 53 with developer of the developer receiving portion 51.

The transfer unit 60 may include an intermediate transfer belt 61 supported by support rollers 64 and 65 to transfer a visible image of the image carrier 42 to the printing medium, a first transfer roller 62, and a second transfer roller 63. The first transfer roller 62 is disposed opposite to the image carrier 42 while interposing the intermediate transfer belt 61 therebetween to transfer the visible image formed on the image carrier 42 to the intermediate transfer belt 61. The second transfer roller 63 is disposed opposite to the support roller 65 while interposing the intermediate transfer belt 61 therebetween to transfer the image on the intermediate transfer belt 61 to the printing medium.

The fixing unit 70 may include a heating roller 71 having a heating source, and a pressure roller 72 installed opposite the heating roller 71 to press the printing medium to the heating roller 71. The heating source may include, for example, a heat lamp (e.g., halogen lamp), heating coil, a resistive heating element, or other heating device. Accordingly, when the printing medium passes through a gap between the heating roller 71 and the pressure roller 72, the developer transferred to the printing medium is fixed to the printing medium by the heat transmitted from the heating roller 71 and by the pressure exerted between the heating roller 71 and the pressure roller 72.

Meanwhile, the printing medium discharge unit 80 includes a discharge roller 81 and a discharge backup roller 82, which are provided at an inner side of the discharge portion 10*c*, to discharge the printing medium passing through the fixing unit 70 to the outside of the body 10.

Hereinafter, the operation of the image forming apparatus will be described. If a printing operation begins, the charging roller 45 uniformly charges the surface of the image carrier 42. The light scanning unit 30 scans light, which corresponds to image information of any one color, yellow for example, to the uniformly charged surface of the image carrier 42, that forms an electrostatic latent image corresponding to yellow image information on the image carrier 42.

Subsequently, a developing bias is applied to the developing roller 53 of the yellow developing unit 50Y to attach a yellow developer to the electrostatic latent image, so that a visible image of yellow color is formed on the image carrier 42. The visible image is transferred to the intermediate transfer belt 61 by the first transfer roller 62.

After the transfer of the yellow color for a page is completed, the light scanning unit 30 scans light, which corresponds to image information of another color, magenta for example, to the light carrier 42, forming an electrostatic latent image corresponding to magenta image information on the image carrier 42. The magenta developing device 50M supplies magenta developer to the electrostatic latent image to form a visible image. The visible image of magenta color is transferred to the intermediate transfer belt 61 by the first transfer roller 62. In this case, the magenta visible image overlaps the previously transferred yellow visible image.

By performing the above described operation for cyan and black colors, a color image is formed on the intermediate transfer belt 61 while having yellow, magenta, cyan, and black images overlapped. The resulting color image is transferred to the printing medium which as the printing medium passes through the gap between the intermediate transfer belt 61 and the second transfer roller 63, and the printing medium is discharged to the outside of the body 10 by way of the fixing unit 70 and the printing medium discharge unit 80.

In the above described process of forming an image on the printing medium, a waste developer may remain on the image carrier 42. If the waste developer is scattered inside the body 10 and accumulated on the drive gear 12, the rotation of the image carrier 42, which is achieved while being engaged with the drive gear 12, becomes unstable, thereby degrading the image quality.

Figure 3:
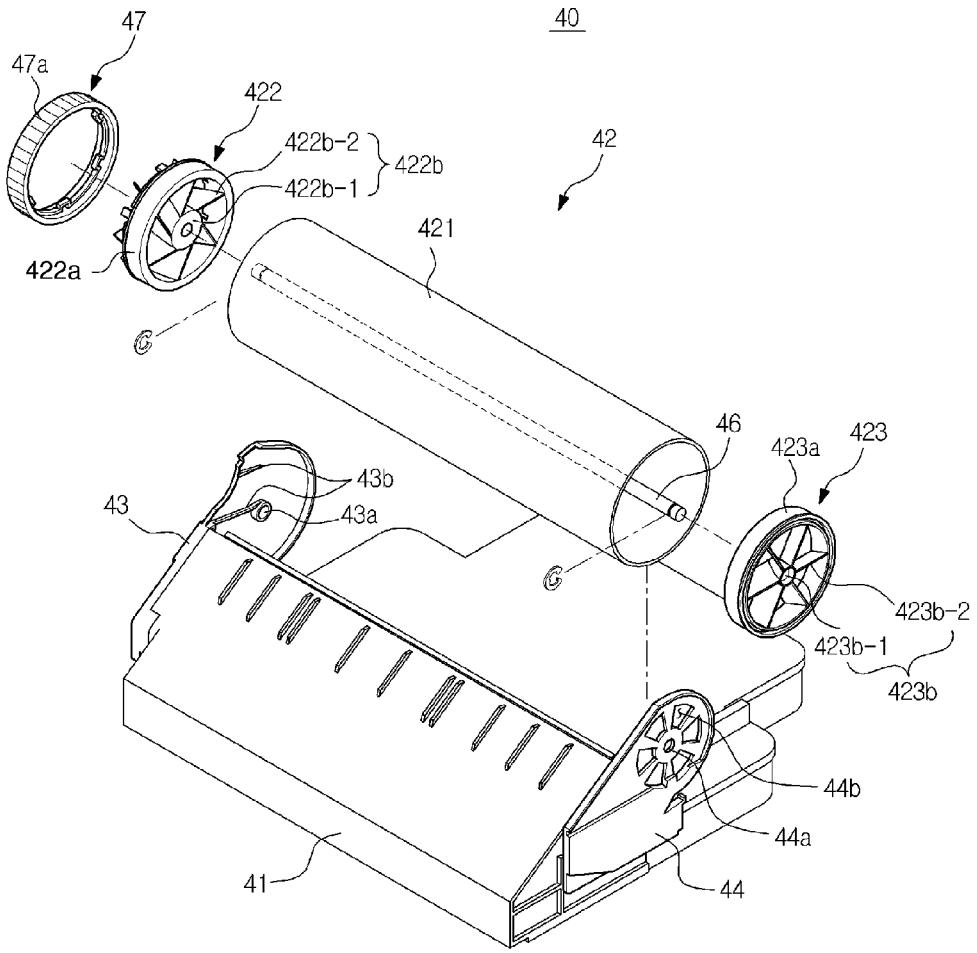
FIG. 3 is an exploded perspective view illustrating an installation state of the image carrier unit applied to the image forming apparatus in accordance with the embodiment of the present disclosure.

Referring to FIGS. 2 and 3, the image carrier 42 may include an image carrier body 421 provided in the form of a cylinder having a hollowness, a first image carrier flange 422 installed at one end of the image carrier body 421, and a second image carrier flange 423 installed at the other end (opposite end) of the image carrier body 421.

The image carrier unit 40, in order to prevent the waste developer from being accumulated on the drive gear 12, is configured such that air is moved from a first end of the image carrier 42, at which the drive gear 12 is positioned, to a second end of the image carrier 42, that is, the opposite end of the first end.

The first image carrier flange 422 and the second image carrier flange 423 may be integrally provided with blower fans 422*b* and 423*b*, respectively, such that air passes through the inside of the image carrier body 421 in one direction. Each of the first image carrier flange 422 and the second image carrier flange 423 include flange portions 422*a* and 423*a*, respectively, that are provided in the form of a ring. Each of the blower fans 422*b* and 423*b* is integrally formed with the flange portion 423*a* at an inner side the flange portion 423*a*. The blower fan 422*b* and 423*b* respectively include hubs 422*b*-1 and 423*b*-1, on which the shaft 46 is installed, and blades 422*b*-2 and 423*b*-2 extending from the hubs 422*b*-1 and 423*b*-1 in a radially outward direction of the hubs 422*b*-1 and 423*b*-1 and may be connected to the flange portion 423*a*. The blades 422*b*-2 and 423*b*-2 include a plurality of blades that are spaced apart from each other in the circumferential direction of the hubs 422*b*-1 and 423*b*-1. The airfoil shape of the blade and the number of blades may be selected as necessary to achieve the desired effect and performance of the blower fans and/or to achieve a desired airflow. For example, the blades may be inclined or curved (e.g., forward-inclined or backward-inclined) or may be substantially straight (e.g., an axial or radial-blade). Blower fans 422*b* and 423*b* may have similarly shaped blades or may have different blade shapes from one another. Blower fans 422*b* and 423*b* may have the same number of blades or may have a different number of blades from one another. Other factors may be considered in selecting the blower fan, including power consumption, noise, heat generation, fan speed (RPM), and the like. The blower fans 422*b* and 423*b* may be configured to allow air to be drawn to the inside of the image carrier body 421 through the second end of the image carrier body 421 and then to be discharged through the first end (the other, opposite end) of the image carrier body 421. For example, the blower fans 422*b* and 423*b* may rotate such that air is drawn into the image carrier body 421 through a first end of the image carrier body 421 (e.g., through an end corresponding to the location of blower fan 422*b*) which corresponds to the same end on which the gear member 47 is disposed, and air may be discharged out through a second end of the image carrier body 421 (e.g., out of an end corresponding to the location of blower fan 423*b*). Alternatively, and more desirably, the blower fans 422*b* and 423*b* may rotate such that air is drawn into the image carrier body 421 through a second end of the image carrier body 421 (e.g., through through-hole 44*b*), and air may be discharged out of the image carrier body 421 through a first end of the image carrier body 421 (e.g., out of the end corresponding to the location of blower fan 422*b*) which corresponds to the same end on which the gear member 47 is disposed. As shown in FIG. 3, for example, blades 422*b*-2 may have an inclined shape while blades 423*b*-2 may be substantially straight. In another alternative embodiment, blower fan 423*b* may direct airflow in a direction parallel to the axis of shaft 46 of the image carrier body 421, while blower fan 422*b* may be a centrifugal fan and direct airflow discharged out of the image carrier body 421 in a different direction, for example in a substantially perpendicular direction (e.g., radially outward direction) relative to the image carrier body 421.

The first image carrier flange 422 is provided with a gear member 47 coupled thereto that is engaged with the drive gear 12 such that the image carrier 42 receives a driving force through the drive gear 12. The gear member 47 may be provided in the form of a ring corresponding to the flange portion 423*a* of the first image carrier flange 422, and may have a gear portion 47*a* which is provided with teeth formed at an outer circumferential surface thereof.

The first image carrier frame 43 and the second image carrier frame 44 may include shaft installation holes 43*a* and 44*a*, respectively, at which both ends of the shaft 46 are rotatably installed, respectively.

The first image carrier frame 43 may include a guide rib 43*b* to guide air which passes through the inside the image carrier body 421 and then is discharged through the one end of the image carrier body 421. The guide rib 43*b* may include a pair of guide ribs 43*b*, which extend from a portion adjacent to the shaft installation hole 43*a* in the radially outward direction of the image carrier body 421, so that the air being discharged through the one end of the image carrier body 421 is guided in a radial outward direction of the image carrier body 421. For example, the two guide ribs 43*b* may extend toward the drive gear 12 so that the air being discharged from the image carrier body 421 is guided to the drive gear 12. As shown in FIG. 3, for example, a first guide rib may have a longer length than the second guide rib. The first guide rib may extend from the first image carrier frame 43 to the shaft installation hole 43*a*, while the second guide rib may be disposed above the first guide rib and extend from the first image carrier frame 43 to an area above the shaft installation hole 43*a*.

The second image carrier frame 44 may include a through-hole 44*b* that is provided at a portion adjacent to the shaft installation hole 44*a* such that air is introduced through the other end of the image carrier body 421 after passing through the second image carrier frame 44. That is, for example, air may flow through the through-hole 44*b*, through the second image carrier frame 44, out of the end of the image carrier body 421 corresponding to the first image carrier frame 43, toward gear member 47. The through-hole 44*b*, for example may include a plurality of through-holes that are provided in a substantially trapezoidal shape and spaced apart from each other in the circumferential direction of the shaft 46 while having the shaft installation hole 44*a* as a center. The through-holes may be spaced apart to correspond to the space formed between the blades of the blower fan. The shape of the through-holes may correspond to the shape formed by the intersection of adjacent blades of the blower fan, the hub, and the flange portion. Alternatively, the plurality of through-holes may have other shapes, for example, circular, semicircular, square, rectangular, triangular, and the like.

Figure 4:
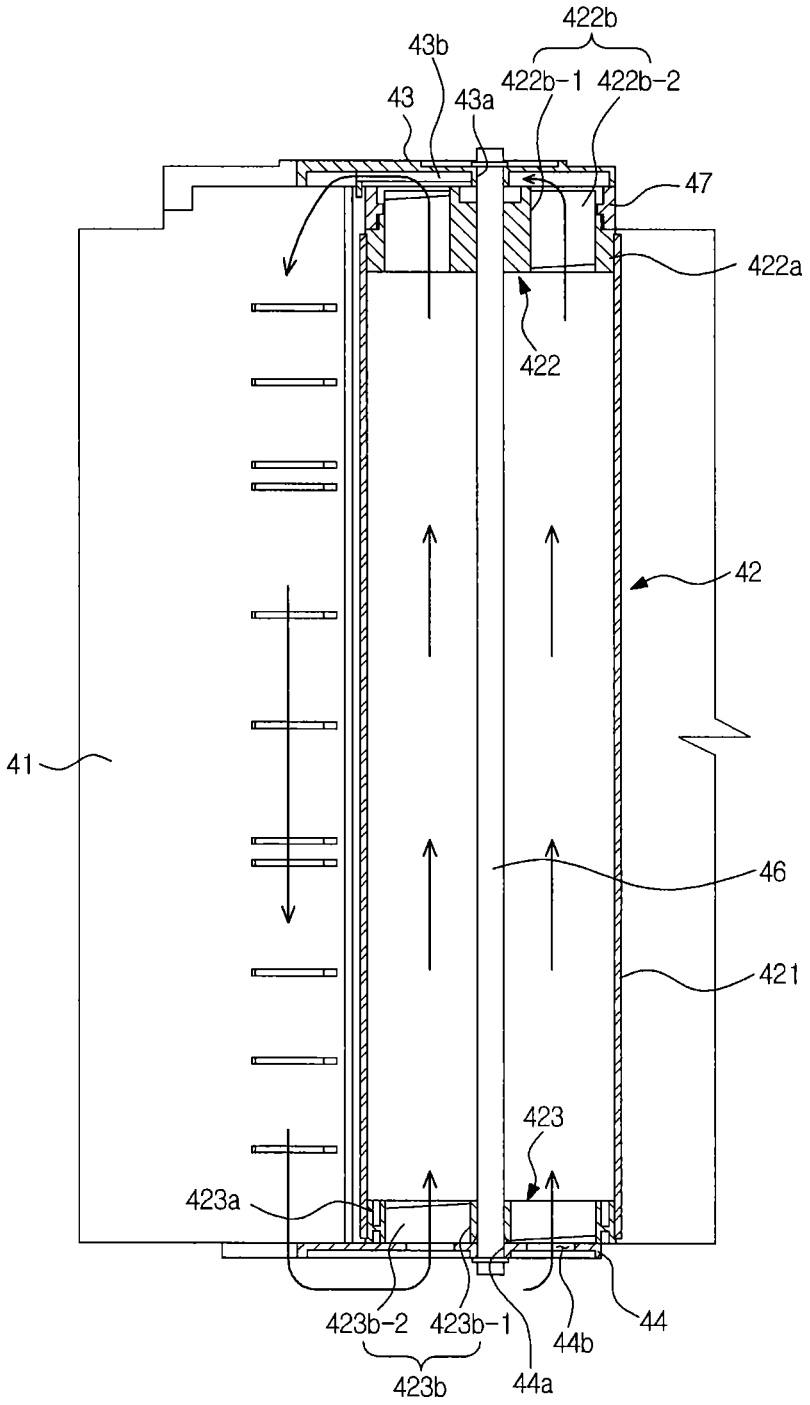
FIG. 4 is a cross-sectional view illustrating the air flow in the image carrier applied to the image forming apparatus in accordance with the embodiment of the present disclosure.

Hereinafter, the operation of the image carrier unit will be described with reference to FIG. 4 in detail.

First, if a rotating force is transmitted to the gear member 47 through the drive gear 12, the image carrier 42 rotates, and the blower fans 422*b* and 423*b*, which are integrally formed with the first image carrier flange 422 and the second image carrier flange 423, respectively, rotate. According to the rotation of the blower fans 422*b* and 423*b*, the air inside the body 10 passes through the through-hole 44*b* as shown in FIG. 4 at a second end of the image carrier body 421. The air which is introduced to the inside of the image carrier body 421 passes through to a first end of the image carrier body 421, which is opposite of the second end. The air being introduced from the second end of the image carrier body 421 is discharged once it passes through the first end of the image carrier body 421. The discharged air is guided radially outward of the image carrier body 421 by the two guide ribs 43*b*, which are provided at the first image carrier frame 43, and then the air is discharged toward the drive gear 12. When the air is discharged toward the drive gear 12, air inside the body 10 is drawn through the second end of the image carrier body 421, so the air being discharged toward the drive gear 12 is moved from the first end of the image carrier body 421, at which the drive gear 12 is disposed, to the second end of the image carrier body 421, which again, corresponds to an opposite end of the first end.

During the rotation of the image carrier 42, the above-described air flow continues at the outside of the image carrier body 421. Accordingly, even if the waste developer is scattered at the inside of the body 10, the waste developer is moved from the first end of the image carrier body 421 to the second end of the image carrier body 421 together with the air. Accordingly, the waste developer is prevented from being accumulated on the drive gear 12 and the gear member 47 that are positioned at the first end of the image carrier body 421.

The first image carrier flange 422 and the second image carrier flange 423 may be integrally provided with the blower fans 422*b* and 423*b*, respectively, but the present disclosure is not limited thereto. For example, only one of the first image carrier flange 422 and the second image carrier flange 423 may be provided with the blower fan.

The gear member 47 may be provided at the outer circumferential surface thereof with the gear portion 47*a* which may be coupled to the first image carrier flange 422, but the present disclosure is not limited thereto. The gear part 47*a* may be integrally formed on the outer circumferential surface of the first image carrier flange 422.

The image forming apparatus may use one or more processors, which may include a microprocessor, central processing unit (CPU), digital signal processor (DSP), or application-specific integrated circuit (ASIC), as well as portions or combinations of these and other processing devices, to perform various functions of the image forming apparatus and image carrier, according to the above-described example embodiments.

In accordance with the above-described example embodiments, the image carrier, and the image forming apparatus having the same, may be constructed such that operational errors related to waste developer accumulating on a drive gear of the image carrier may be avoided. The above-disclosed image carrier is capable of transferring waste developer, which may be scattered inside a body of the image forming apparatus, from one end of the image carrier in which the drive gear is disposed, to an opposite end of the image carrier, by generating an airflow using one or more blower fans. The airflow may be directed from a second end of the image carrier having a plurality of through-holes through an image carrier body, and out of a first end of the image carrier which is disposed adjacent to the drive gear. The first end of the image carrier may include one or more guide ribs which guides the airflow in an outward radial direction such that waste developer, which would otherwise accumulate on the drive gear, is moved from the first end of the image carrier to the second end of the image carrier.

One of ordinary skill in the art would understand that the above-disclosed image carrier may be included in various image forming devices, including a printer, a copy machine, a facsimile, and a multifunctional device which incorporates the functionalities of the printer, the copy machine, and the facsimile (which may be referred to as a multifunctional peripheral device or MFP). Additionally, the printer may have the capability for single-sided printing and/or duplex printing, and is not limited to the example embodiment of the printer shown in FIG. 1. Further, the printer may have more or less than the four developing devices shown in FIG. 1, and may include only a single developing device with a single color, or may include developing devices having colors other than, or in addition to, yellow, magenta, cyan, and/or black, (e.g., orange, green, blue, red, etc.).

Although a few example embodiments of the present disclosure have been shown and described, it would be appreciated by those skilled in the art that changes may be made to these embodiments without departing from the principles and spirit of the disclosure, the scope of which is defined in the claims and their equivalents.

What is claimed is:

1. An image forming apparatus, comprising:

an image carrier on which an electrostatic latent image is formed;

a first image carrier frame installed on a first side of the image carrier; and a second image carrier frame installed on a second side of the image carrier, opposite to the first side, wherein the image carrier comprises:

an image carrier body;

a first image carrier flange installed at a first end of the image carrier body; and a second image carrier flange installed at a second end of the image carrier body, opposite to the first end, wherein at least one of the first image carrier flange and the second image carrier flange includes a blower fan to guide air to pass through the image carrier body in one direction, wherein the first image carrier frame includes a guide rib configured to guide air, which is discharged through the first end of the image carrier body, toward a radially outward direction of the image carrier body, and wherein the second image carrier frame includes a through-hole that allows air to pass through the second image carrier frame to inside the image carrier body.

2. The image forming apparatus of claim 1, wherein the at least one blower fan allows the air to be drawn to the inside of the image carrier body through the second end of the image carrier body and then to be discharged through the first end of the image carrier body.

3. The image forming apparatus of claim 2, further comprising a drive gear configured to transmit a rotating force to the image carrier, wherein the first image carrier flange is provided at an outer circumferential surface thereof with a gear portion that is engaged with the drive gear.

4. The image forming apparatus of claim 3, wherein the first image carrier flange comprises a ring-shaped flange portion, wherein the image forming apparatus further comprises a ring-shaped gear member corresponding to the flange portion and provided at an outer circumferential surface thereof with the gear portion, and wherein the gear member is coupled to the first image carrier flange.

5. The image forming apparatus of claim 3, wherein the guide rib extends toward the drive gear to guide the air, which is discharged through the first end of the image carrier body, toward the drive gear.

6. An image forming apparatus, comprising:

an image carrier on which an electrostatic latent image is formed; and a shaft to enable the image carrier to be rotatably installed, wherein the image carrier comprises:

a hollow image carrier body;

a first image carrier flange installed at a first end of the image carrier body; and a second image carrier flange installed at a second end of the image carrier body, opposite of the first end; and a first image carrier frame to rotatably support a first end of the shaft and a second image carrier frame to rotatably support a second end of the shaft, opposite to the first end of the shaft, wherein at least one of the first image carrier flange and the second image carrier flange is integrally provided with a blower fan to enable air to pass through the image carrier body from the second end of the image carrier body to the first end of the image carrier body, and the first image carrier frame comprises a guide rib configured to guide air to a radially outward direction of the image carrier body.

7. The image forming apparatus of claim 6, wherein the first image carrier flange and the second image carrier flange each include a ring-shaped flange portion to correspond to the image carrier body, and the at least one blower fan is integrally formed with the corresponding flange portion at an inner side of the flange portion.

8. The image forming apparatus of claim 7, wherein the at least one blower fan comprises a hub at which the shaft is installed, and a plurality of blades which extend from the hub in a radially outward direction of the hub so as to be connected to the flange portion while being spaced apart from each other in a circumferential direction of the hub.

9. The image forming apparatus of claim 7, wherein the flange portion corresponding to the first image carrier flange is provided at an outer circumferential surface thereof with a gear portion that is supplied with a rotating force from a drive gear.

10. The image forming apparatus of claim 9, further comprising a ring-shaped gear member corresponding to the flange portion of the first image carrier flange, and provided at an outer circumferential surface thereof with the gear portion, wherein the gear member is coupled to the first image carrier flange.

11. The image forming apparatus of claim 6, wherein the first image carrier frame and the second image carrier frame each include a shaft installation hole such that both ends of the shaft are rotatably installed on the shaft installation hole of the first image carrier frame and the shaft installation hole of the second image carrier, respectively, wherein the at least one blower fan enables air to pass through the image carrier body from the second image carrier frame to the first image carrier frame.

12. The image forming apparatus of claim 11, further comprising a drive gear configured to transmit a rotating force to the image carrier, wherein the guide rib extends toward the drive gear such that air being discharged through the first end of the image carrier body is guided toward the drive gear.

13. The image forming apparatus of claim 11, wherein the second image carrier frame comprises at least one through-hole disposed adjacent to the shaft installation hole such that air is drawn to inside of the image carrier body as the air through the second image carrier frame.

14. The image forming apparatus of claim 13, wherein the at least one through-hole comprises a plurality of through-holes that are disposed on the shaft installation hole, which are spaced apart from each other in a circumferential direction of the shaft.

15. An image carrier, comprising:

an hollow cylinder-shaped image carrier body;

a shaft disposed along a central longitudinal axis of the image carrier body;

a pair of flanges installed at first and second ends of the image carrier body, respectively; and a first image carrier frame to rotatably support a first end of the shaft, wherein at least one of the flanges comprises a blower fan that allows air to pass through an inside of the image carrier body in one direction, and the first image carrier frame comprises a guide rib configured to guide air to a radially outward direction of the image carrier body.

16. The image carrier of claim 15, wherein each flange comprises a ring-shaped flange portion installed in the first and second ends of the image carrier body, and wherein the blower fan is integrally formed with the flange portion of the at least one flange at an inner side of the flange portion.

17. The image carrier of claim 16, wherein the blower fan comprises a hub at which the shaft is installed, and a plurality of blades that extend from the hub in a radially outward direction of the hub so as to be connected to the flange portion while being spaced apart from each other in a circumferential direction of the hub.

18. An image carrier disposed in an image forming apparatus, the image carrier comprising:

a hollow image carrier body;

a shaft disposed inside the image carrier body along a central longitudinal axis of the image carrier body;

a first blower fan disposed at a first end of the image carrier body to draw air into the image carrier body through a second end of the image carrier body, and to discharge air out of the image carrier body through the first end of the image carrier body; and a second blower fan disposed at the second end of the image carrier body to guide air inside of the image carrier body; and a first image carrier frame including a first shaft installation hole to support a first end of the shaft and a plurality of guide ribs to guide air discharged from the first blower fan out of the image carrier body in a radially outward direction.

19. The image carrier of claim 18, wherein the second blower fan guides air in a direction parallel to the central longitudinal axis of the image carrier body.

20. The image carrier of claim 19, further comprising:

a second image carrier frame including a second shaft installation hole to support a second end of the shaft and a plurality of through holes arranged circumferentially about the second shaft installation through which air is drawn into the image carrier body.

21. The image carrier of claim 18, further comprising:

a flange installed at the first end of the image carrier body; and a gear member coupled to the flange, wherein a drive gear of the image forming apparatus engages the gear member to transmit a rotating force to the image carrier body, first blower fan, and second blower fan such that air discharged from the first blower fan prevents waste developer from accumulating on the drive gear.

22. The image carrier of claim 18, wherein the first blower fan includes a plurality of blades and the second blower fan includes a plurality of blades, the plurality of blades of the first blower fan being shaped differently from the plurality of blades of the second blower fan.

23. The image carrier of claim 18, wherein the first blower fan is a centrifugal type blower fan, and the second blower fan is an axial type blower fan.

* * * * *

UNITED STATES PATENT AND TRADEMARK OFFICE

CERTIFICATE OF CORRECTION

PATENT NO. : 8,867,952 B2
APPLICATION NO. : 13/684889
DATED : October 21, 2014
INVENTOR(S) : Sung Jin Kim et al.

It is certified that error appears in the above-identified patent and that said Letters Patent is hereby corrected as shown below:

In the Claims

Column 11, line 22, in Claim 18, after “body;” delete “and”.

Signed and Sealed this
Second Day of June, 2015

Michelle K. Lee

Michelle K. Lee
*Director of the United States Patent and Trademark Office*